US008742696B2

(12) United States Patent
Tai et al.

(10) Patent No.: US 8,742,696 B2
(45) Date of Patent: Jun. 3, 2014

(54) ILLUMINATING APPARATUS AND METHOD THEREOF

(75) Inventors: Shih-Neng Tai, Taoyuan County (TW); Chia-Tin Chung, Miaoli County (TW)

(73) Assignee: Paragon Semiconductor Lighting Technology Co., Ltd., Taoyuan County (TW)

( * ) Notice: Subject to any disclaimer, the term of this patent is extended or adjusted under 35 U.S.C. 154(b) by 340 days.

(21) Appl. No.: 13/182,413

(22) Filed: Jul. 13, 2011

(65) Prior Publication Data

US 2013/0015773 A1 Jan. 17, 2013

(51) Int. Cl.
*H05B 37/02* (2006.01)

(52) U.S. Cl.
USPC ..... 315/308; 315/294; 315/299; 315/360

(58) Field of Classification Search
USPC ..... 315/185 R, 192, 193, 291, 294, 299, 315/308, 360
See application file for complete search history.

(56) References Cited

U.S. PATENT DOCUMENTS

| | | | | |
|---|---|---|---|---|
| 8,207,685 | B2 * | 6/2012 | Cheng et al. | 315/306 |
| 2010/0308738 | A1 * | 12/2010 | Shteynberg et al. | 315/185 R |
| 2013/0002153 | A1 * | 1/2013 | Liu | 315/185 R |

* cited by examiner

*Primary Examiner* — Thuy Vinh Tran
(74) *Attorney, Agent, or Firm* — Li & Cai Intellectual Property (USA) Office

(57) ABSTRACT

An illuminating apparatus adapted to receive an input power which is a pulse DC includes a lighting unit, a detecting unit and a controlling unit. The lighting unit includes a plurality of lighting sets and a switching unit. The switching unit may be used to cause the lighting sets interconnected in a serial fashion and/or in a parallel manner. The detecting unit detects a state of the input power. The control unit couples the detecting unit and the lighting unit, and controls the switching unit according to the detecting unit detecting the state of the input power. As such, the turn-on voltages of the lighting unit may adjust at different stages of the input power.

14 Claims, 6 Drawing Sheets

ILLUMINATING APPARATUS AND METHOD THEREOF

BACKGROUND OF THE INVENTION

1. Field of the Invention

The present invention relates to an illuminating apparatus and method thereof; in particular, to a light emitting diode (LED)-based illuminating apparatus and method thereof.

2. Description of Related Art

Thanks for characteristics of low power consumption, high brightness, and long duration associated with LEDs, the LEDs are gradually applicable to various lighting means. Please refer to FIG. 1, which is a schematic diagram of a conventional illuminating means. The conventional illuminating means includes a rectifying circuit 90, a lighting set 92 and a current source 94. The illuminating means further includes a plurality of LEDs in serial connection. In one implementation, the rectifying circuit 90 is a full-wave rectifying circuit for converting an alternating current (AC) current into a direct current (DC), which serves as an input power for the LEDs. When the serial-connected LEDs are turned on, the current source 94 provides a steady current for each of the LEDs in the lighting set 92.

For improving brightness of the lighting means, conventionally, a plurality of LEDs are serial-connected, however, correspondingly increasing a turn-on voltage of the lighting set 92. With the increased turn-on voltage of the lighting set 92, such lighting set 92 is conducted only when a voltage level of the input power is larger than the turn-on voltage. Therefore, a flashing effect associated with the lighting set 92 would be more significant.

SUMMARY OF THE INVENTION

The object of the present invention is for providing an illuminating apparatus and method thereof to address the issue of the foregoing drawbacks.

According to one embodiment, an illuminating apparatus is provided to receive a pulse DC as an input power being comprises a lighting unit, a detecting unit and a controlling unit. The lighting unit comprises a plurality of lighting sets and a switching unit, the switching unit is adapted to cause the lighting sets to be connected with each other serially or in parallel. The detecting unit is adapted to detect state of the input power. And the controlling unit is coupled to the detecting unit and switching unit, and bases upon the detecting unit detecting the state of the input power controls the switching unit.

Another embodiment of the present invention is for providing an illuminating apparatus having a lighting unit, a detecting unit and a control unit. The lighting unit comprises a plurality of inter-coupled LED modules, and each of the LED modules includes a first lighting set, a second lighting set and a switching circuit. The first lighting set is composed of a plurality of first LEDs in a serial connection. The second lighting set is composed of a plurality of second LEDs in a serial connection. The switching circuit coupled between the first lighting sets and the second lighting set is for causing changes to connection relationship between the first lighting set and the second lighting set. The detecting unit is adapted for detecting the state of the input power. The controlling unit is coupled to the detecting unit and the switching circuit, and base upon the detecting unit detecting the state of the input power controls the switching circuit to cause the changes to the connection relationship between the first lighting sets and the second lighting sets.

Still another embodiment of the present invention is for providing an illuminating method including detecting the state of the input power and controlling the switching unit according to detecting the state of the input power.

Hence, according to the disclosures of the foregoing embodiments, improvements can be made as such: For the illuminating apparatus, its turn-on voltage can be adjusted so as to extend turn-on time of the lighting unit within a period time of the input power, and thus reducing the flashing of the lighting unit during the lighting.

In order to further the understanding regarding the present invention, the following embodiments are provided along with illustrations to facilitate the disclosure of the present invention.

DETAILED DESCRIPTION OF THE PREFERRED EMBODIMENTS

The present invention relates to an illuminating apparatus and method thereof. The illuminating apparatus refers to a lighting array having a plurality of lighting LEDs, and by means of serial/parallel connections between the LEDs, the turn-on voltage for the lighting array may be adjustable. For example, when the input power fails to turn on all of the serially connected LEDs, some or all of the LEDs may be adapted to be in a parallel connection to reduce the turn-on voltage of the lighting array, so as to extend a time period during which the illuminating apparatus is turned on.

Figure 1:
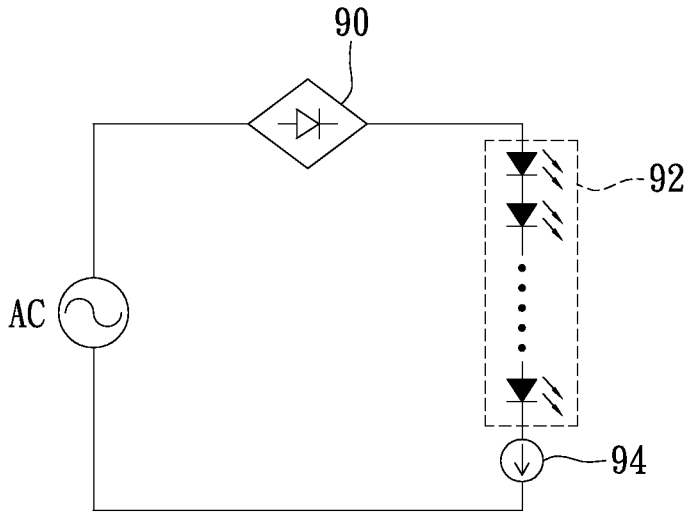
FIG. 1 PRIOR ART
FIG. 1 shows a schematic diagram of a conventional illuminating means.
Figure 2:
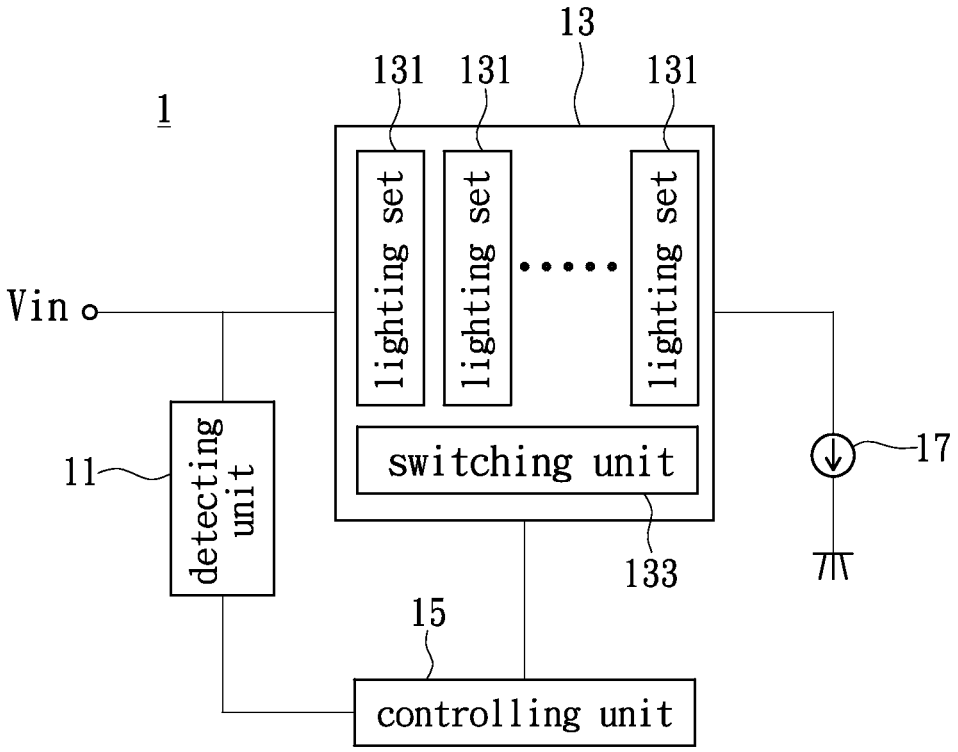
FIG. 2 shows a simplified block diagram of the illuminating apparatus according to an embodiment of the present invention.

Please refer to FIG. 2, which is a simplified block diagram for the illuminating apparatus according to an embodiment of the present invention. An illuminating apparatus 1 includes a detecting unit 11, a lighting unit 13 and a controlling unit 15 coupled between the detecting unit 11 and the lighting unit 13.

The detecting unit 11 is adapted for detecting a state of an input power Vin applied to the lighting unit 13. For example, the detecting unit 11 may sense a phase variation or a voltage variation of the input power Vin. As such, the detecting unit 11 may be a phase detecting circuit or a voltage detecting circuit but not limited thereto. The input power may be a pulse DC, for example, which is a product of a rectified AC power.

Furthermore, the pulse DC may be a full-waved or half-waved pulse DC. And the following description adopts full-waved pulse DC as the input power for the illustration purposes.

The lighting unit 13 includes a plurality of lighting sets 131 and a switching unit 133. The lighting sets 131 may include a plurality of LEDs with connections between the lighting sets 131 adjustable according to the state of the input power. The switching unit 133, meanwhile, includes a plurality of switching devices and/or related circuit device (such as a unilateral-conducting device).

The switching unit 133 may be adapted to cause a serial connection or a parallel connection between the lighting sets 131. For example, under the control of the switching unit 133, one of the lighting units 131 may be connected in the serial connection or alternatively in the parallel connection with another one or other lighting sets 131. In another implementation, the lighting sets 131 may be divided into a plurality of groups and each of the groups may include a plurality of lighting sets 131 inter-connected with each other serially or in parallel, and the groups themselves may be further interconnected with each other serially or in parallel. The control unit 15 controls the switching unit 133 according to the detecting unit 11 detecting the state of the input power to adjust the connection between the lighting sets 131 of the lighting unit 13. For example, when the detecting unit 11 detects a voltage of the input power Vin is larger than the turn-on voltage of one set of the lighting sets 131 or the turn-on voltages of a plurality of lighting sets 131 in the serial connection, the controlling unit 15 may thus operate to control the switching unit 133 to cause the lighting sets 131 to be connected serially or in parallel. In one implementation, the detecting unit 11 may be configured to detect the state of the input power at predetermined points within a time period of the input power waveform (e.g., the time period of the pulse DC). In another implementation, the detecting unit 11 may be configured to detect the voltage of the input power before determining whether the voltage of the input power has reached predetermined voltage levels.

The illuminating apparatus 1 may further include a current source 17 coupled to the lighting unit 13 and capable of providing a steady current when the lighting sets 131 in the lighting unit 13 are turned on. The current source 17 may also provide an adjustable current under the control of the controlling unit 15. More specifically, when the turn-on voltage of the lighting sets 131 is smaller, indicative of the lighting sets 131 may be connected with each other in parallel, a larger turn-on current may become necessary, prompting the adjustable current source 17 to offer a corresponding larger current to the lighting sets 131. On the other hand, when the turn-in voltage of the lighting sets 131 is larger, which indicates the lighting sets 131 may be in the serial connection among themselves and thus necessities a corresponding smaller turn-in current for the lighting sets 131, the current source 17 may be adjusted to provide the current of the smaller value with the lighting sets 131.

Figure 3:
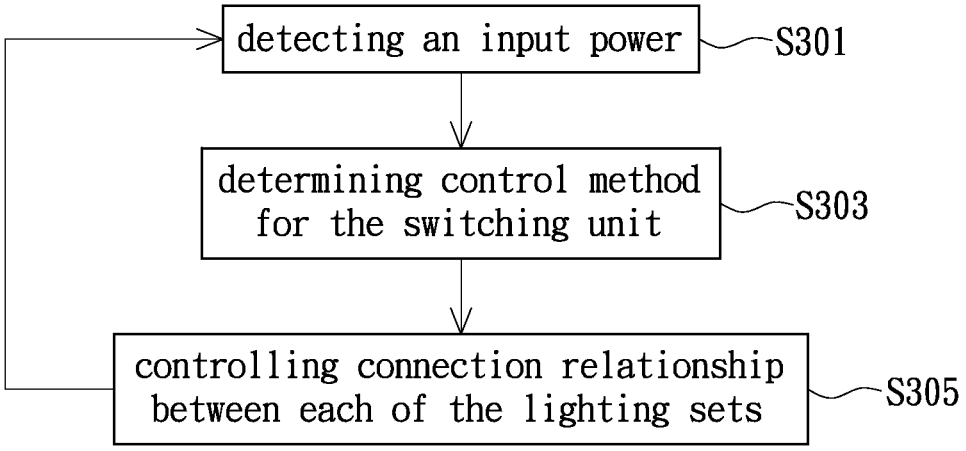
FIG. 3 shows a flow chart of the illuminating method according to an embodiment of the present invention.

In conjunction with FIG. 2, please refer to FIG. 3, which relates to a flow chart for the illuminating method according to an embodiment of the present invention.

The control unit 15 detects the state of the input power via the detecting unit 11 (step S301) so as to determine the state of the input power. In one implementation, the state of the input power may be a phase a waveform of the input power. In another implementation, the state of the input power may be in terms of predetermined time values counting from the zero phase of the input power waveform. According to the detecting unit 11 detecting the state of the input power, the control unit 15 may determine whether the predetermined time values have been reached (step S303). When the predetermined time values have been reached, the control unit 15 bases upon the predetermined time values, all of which may correspond to their respective turn-on voltages of the lighting unit 13, may control the switching unit 133 to manipulate connection relationships between each lighting unit 13 (step S305), so that each of the lighting sets 131 may be turned on uninterruptedly with this particular turn-on voltage. It is worth noting that the aforementioned steps may be performed repeatedly.

Figure 4:
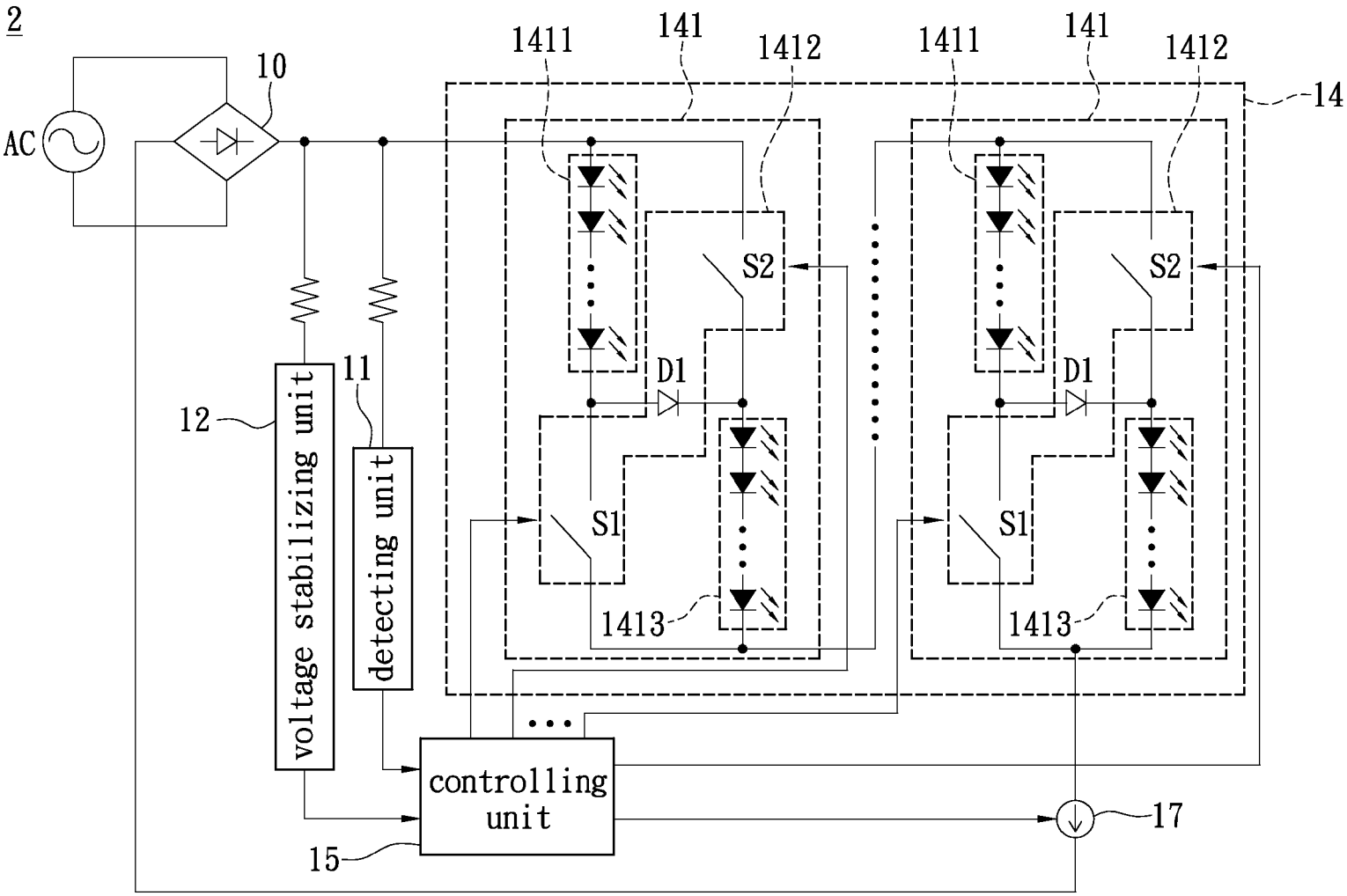
FIG. 4 shows a simplified block diagram of the illuminating apparatus according to one embodiment of the present invention integrating with a power supply.

Please refer to FIG. 4, which relates to a simplified block diagram of the illuminating apparatus according to another embodiment of the present invention integrating with a power supply. An illuminating apparatus 2 includes a rectifying unit 10, a detecting unit 11, a voltage stabilizing unit 12, a lighting unit 14, a controlling unit 15 and a current source 17. The rectifying unit 10 is coupled to the detecting unit 11, the voltage stabilizing unit 12, and the lighting unit 14. The controlling unit 15 is coupled to the detecting unit 11, the voltage stabilizing unit 12 and the lighting unit 14.

In one implementation, the rectifying unit 10 may be a full-wave rectifying circuit, for rectifying an AC power waveform into an input power source adapted for the lighting unit 14, which may require a full-wave pulse DC as its input power. What is noteworthy is the rectifying unit 10 is not limited thereto, which may be implemented by a half-wave rectifying circuit.

The detecting unit 11 is adapted to detect the state of the input power. As previously mentioned, the detecting unit 11 may be also a phase detection circuit or a voltage detection circuit.

The voltage stabilizing unit 12 is adapted to stabilize the input power in order to output a DC current source with a steady voltage value to serve the control unit 15.

The lighting unit 14, meanwhile, includes a plurality of LED modules which are connected serially with each other, and each of the LED modules 141 further includes a plurality of lighting sets and a switching circuit 1412. In one implementation, the LED module 141 may include two lighting sets having a first lighting set 1411 and a second lighting set 1413. The first lighting set 1411 and the second lighting set 141 each includes LEDs which are inter-connected in serial and equal in the number. And each of the lighting sets is adapted to receive the input power and is turned on when the voltage of the input power exceeds the turn-on voltage of the lighting set.

The switching circuit 1412 further includes a first switching device S1, the second switching device S2 and a unilateral-conducting device D1. The first switching device S1 may be coupled to one side of the first lighting set 1411, the second switching device S2 may be coupled to one side of the second lighting set 1413, and the unilateral-conducting device may be coupled between the first lighting set 1411 and the second lighting set 1413. The first switching device S1 and the second switching device S2 may be a machinery switch or an electronic switch. When the first switching device S1 and the second switching device S2 are the electronic switches, they may be implemented in terms of a Darlington circuit. The unilateral-conducting device D1 may be a diode.

When both the first switching device S1 and the second switching device S2 are both non-conducted, the first lighting set 1411, the unilateral-conducting device D1 and the second lighting set 1412 are serially connected. And when both the first switching device S1 and the second switching device S2 are conducted, the first lighting set 1411 and the second lighting set 1413 are connected in parallel with the unilateral-conducting device D1 non-conducted.

More specifically, the first lighting set 1411 and the second lighting set 1413 may be connected in the serial manner or in the parallel manner and the connection relationship between the first lighting set 1411 and the second lighting set 1413 may be determined by the switching circuit 1412. In other words, the switching circuit 1412 that is controlled by the controlling unit 15 may be configured to switch the first lighting set 1411 and the second lighting set 1412 so that the turn-on voltage of the lighting unit 14 may range between a lowest turn-on voltage when the first lighting set 1411 and the second lighting set 1413 are connected in parallel and a highest turn-on voltage when the first lighting set 1411 and the second lighting set 1413 are serially connected. For example, in view of the lighting unit 14 illustrated in FIG. 4, when the first lighting set 1411 and the second lighting set 1413 of each of the LED modules 141 are connected in parallel, the lowest turn-on voltage of the lighting unit 14 is "n" times the turn-on voltage for the single lighting set, where "n" refers to the amount of the LED module 141 in the lighting unit 14. The highest turn-on voltage of the lighting unit 14 is "2n" times the turn-on voltage drop of the lighting set with n referring to the amount of the LED module 141 in the lighting unit 14.

The state of the input power may dictate the connection relationship between the first lighting set 1411 and the second lighting set 1413. For example, at least one voltage level may be set and when the input power has reached any particular voltage level the switching circuit 1412 may switch on the first switching device S1 and the second switching device S2 in all of the LED modules 141. In another implementation, when the input power reaches another predetermined voltage level the switching circuit 1412 may switch on the first switching device S1 and the second switching device S2 in some of the LED modules 141. In doing so, the controlling unit 15 may ensure the input power regardless of the state thereof may be sufficient to turn on all the lighting sets that are switched on by the switching circuit 1412.

In another aspect, when the control unit 15 adjusts the turn-on voltage of the lighting unit 14 via the switching circuit 1412, a current volume for the current source 17 of the lighting unit 14 may be simultaneously adjusted.

Figure 5:
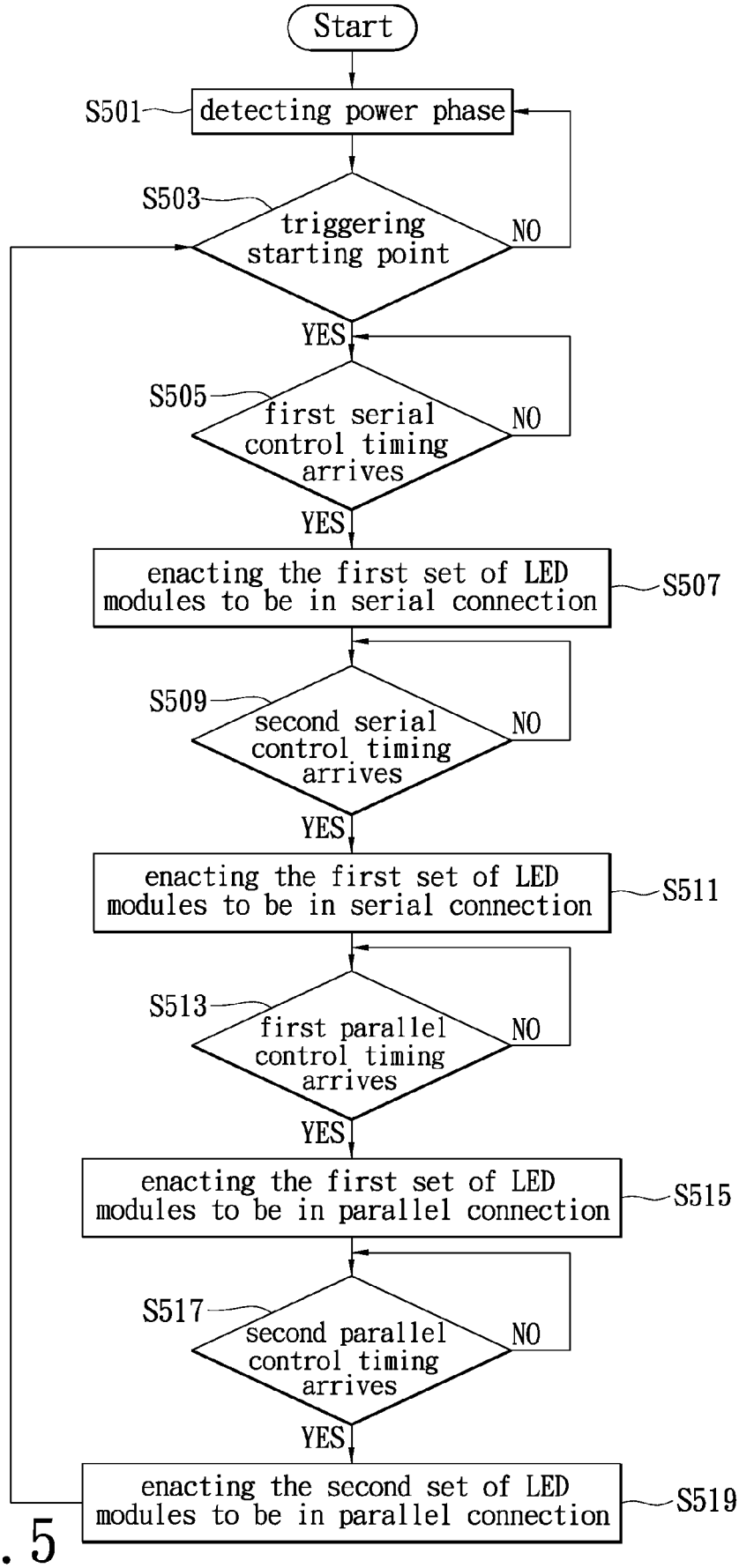
FIG. 5 shows a flow chart of an illuminating method according to one embodiment of the present invention.

Please refer to FIG. 5, which relates to a flow chart of an illuminating method according to one embodiment of the present invention. Please also refer to FIG. 4 and FIG. 6 in conjunction with FIG. 5. For the illustration purpose, in FIG. 4 the LED modules 141 each includes two lighting sets and the detecting unit 11 is implemented by the phase detecting circuit.

Figure 6:
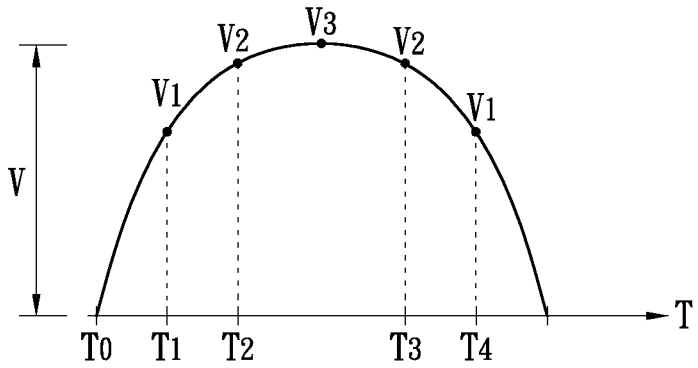
FIG. 6 shows a schematic diagram showing the input power waveform plot for the input power and the turn-on voltage of the illuminating apparatus according to the present invention.

FIG. 6 is a schematic diagram showing the input power waveform and turn-on voltages of the illuminating apparatus according to the present invention. The illuminating apparatus 2 is adapted to detect via the phase detecting circuit or bases upon specifications of the input power (such as voltage or frequency) to determine the input power is a periodical signal and thus set up predetermined time values within a time period of the periodical input power. The predetermined time values may be determined based on the turn-on voltages of the lighting unit 14 (such as V1, V2), each of which may correspond to the time values of the input power waveform (such as T1, T2, T3, T4). Therefore, when the time values are reached the switching circuit 1412 in the lighting unit 14 may in turn adjust the serial/parallel connection of the first lighting set 1411 and the second lighting set 1413 to ensure that the corresponding turn-on voltages associated with the time values are sufficient enough to turn on the lighting sets connected with each other in corresponding ways.

For the illustration purposes, the initial connection relationship between the first lighting set and the second lighting set in each of the LED module 141 is in parallel.

The phase detecting circuit the controlling unit 15 detects the phase of the input power (step S501). According to detection result in S501, the controlling unit determines whether to trigger the determination of the predetermined time values are reached (step S503). In one implementation, to trigger such determination is when the input power waveform is at the zero phase thereof such as T0.

When step S503 determines that the input power waveform is at its zero phase, the controlling unit 15 starts counting from T0 before determining whether T1 has been reached (step S505). When T1 is reached, the controlling unit 15 causes the first lighting set 1411 and the second lighting set 1413 of the first LED module 141 to be in the serial connection by switching off the first switching device S1 and the second switching device S2 (step S507). And then the turn-on voltage of the lighting unit 14 having the first lighting set 1411 and the second lighting set 1413 of the first Led module serially connected may be V1.

The controlling unit 15 further determines whether another predetermined time value T2 has been reached (step S509). If so, the controlling unit 15 may further cause the first lighting set 1411 and the second lighting set 1412 of another LED module 141 (e.g., a second LED module) to be in the serial connection (step S511) by switching off the first and second switching devices S1 and S2. And then the turn-on voltage of the lighting unit 14 having the first lighting set 1411 and the second lighting set 1413 of the second LED module in the serial connection may be at V2.

The controlling unit 15 may be configured to further determine whether another predetermined time value T3 has been reached (step S513). If so, the controlling unit 15 may be configured to cause the first lighting set 1411 and the second lighting set 1413 in the first LED module 141 to be in the parallel connection by switching on the first and second switching devices S1 and S2 in the first LED module 141 (step S515). And the turn-on voltage of the lighting unit 14 having the first lighting set 1411 and the second lighting set 1413 of the first LED module 141 that is in the parallel connection may be at V2.

Additionally, the controlling unit 15 determines whether another predetermined time value T4 has been reached (step S517). If so, the controlling unit 15 may be configured to cause the first lighting set 1411 and the second lighting set 1413 of the second LED module 141 to be in the parallel connection by switching on the first and second switching devices S1 and S2 in the second LED module 141 (step S519). And the turn-on voltage of the lighting unit 14 having the first lighting set 1411 and the second lighting set 1413 of the second LED module 141 may be at V1.

The foregoing S501~S519 illustrate operations of the controlling unit 15 in a single time period of the input power waveform and may be repeatedly performed in the subsequent time periods of the input power waveform.

Plus, when S507 and S511 are executed, the controlling unit 15 may simultaneously control the current source 17 to reduce the current that is provided with the lighting unit 14 so that the minimum requirement sufficient to cause the lighting unit 14 to illuminate may be met. And while S515 and S519 are executed, the controlling unit 15 may simultaneously control the current source 17 to provide another current of an increased value that is at the minimum requirement for the lighting unit 14 to illuminate.

Hence, according to FIG. 5, before the input power waveform reaches a peak V3 thereof the number of the first lighting set 1411 and the second lighting set 1413 that are in the serial connection increases, resulting in the increased turn-on voltage for the lighting unit 14. On the other hand, after the input power reaches the peak of V3 the number of the first lighting set 1411 and the second lighting set 1413 in the lighting unit 14 that are connected in parallel may increase as well, decreasing the required turn-on voltage of the lighting unit 14.

Additionally, in the foregoing description for FIG. 5, whether to cause the serial/parallel connections between the first lighting set 1411 and the second lighting set 1412 in each of the LED module 141 is determined on basis of whether the predetermined time values relative to the zero phase of the input power waveform has been reached. In another implementation, the controlling unit 15 may be configured to cause the changes to the connection relationship between the first lighting set 1411 and the second lighting set 1412 in all lighting units 141. When the controlling unit 15 detects the voltages of the input power waveform reach the predetermined voltage levels associated with the predetermined time values T1-T4, the connection relationship between the first lighting set 1141 and the second lighting set 1143 may be altered.

Figure 7:
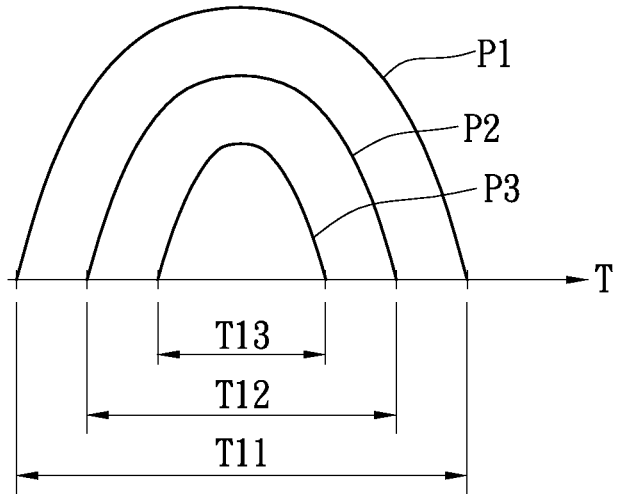
FIG. 7 shows a schematic diagram illustrating a comparison of periods during which the illuminating apparatus according to the present invention and the conventional illuminating apparatus are turned on, respectively.

Please refer to FIG. 7, which relates to a comparison of periods during which the illuminating apparatus according to the present invention and the conventional illuminating apparatus are turned on, respectively. Assume the present invention illuminating apparatus and the conventional illuminating apparatus include LEDs of the same number with the LEDs in the conventional apparatus connected with each other serially. The waveform P1 stands for the waveform of the input power in a single time period T11, the waveform P2 is associated with the illuminating apparatus according to the present invention while the waveform P3 corresponds to the conventional illuminating apparatus. More specifically, the waveforms P2 and P3 indicate that the period during which the illuminating apparatus could be turned on (T12) within the time period of the input power waveform (i.e., T11) is larger and earlier than the period during which the conventional illuminating apparatus could be turned on (T13) within the same time period of the input power.

Figure 8:
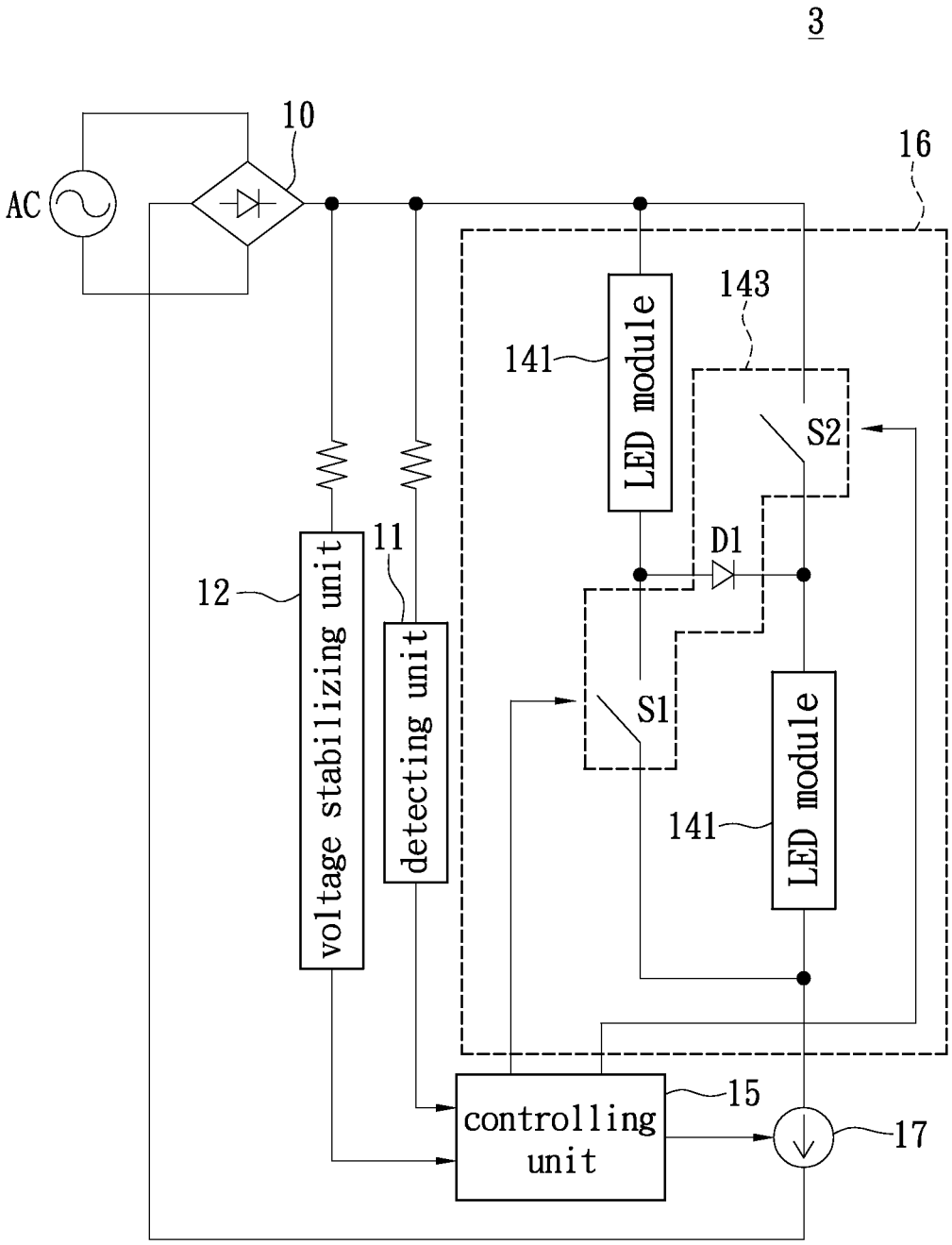
FIG. 8 shows a simplified block diagram of the illuminating apparatus according to another embodiment of the present invention.

Please refer to FIG. 8, which relates to a simplified block diagram for the illuminating apparatus according to another embodiment of the present invention. The difference between the illuminating apparatus illustrated in FIG. 8 and the illuminating apparatus illustrated in FIG. 4 is the switching circuit 143 may be coupled between the LED modules 141 when the LED modules 141 are in the serial or parallel connection.

To sum up, by adjusting the connection relationship between the lighting sets of the lighting unit at different stages of the input power the turn-on voltage of the lighting unit may be adjusted and the period during which the lighting unit is turned on may extend, effectively minimizing the flash phenomenon associated with the conventional illuminating apparatus.

The descriptions illustrated supra set forth simply the preferred embodiments of the present invention; however, the characteristics of the present invention are by no means restricted thereto. All changes, alternations, or modifications conveniently considered by those skilled in the art are deemed to be encompassed within the scope of the present invention delineated by the following claims.

What is claimed is:

1. An illuminating apparatus, adapted to receive an input power which is a pulse DC, comprising:

a lighting unit, having a plurality of lighting sets and a switching unit for interconnecting the lighting sets in a serial manner or in a parallel manner, wherein each one of the lighting set comprises a plurality of serial-connected LEDs;

a detecting unit, for detecting a state for the input power inputted to the lighting unit; and a controlling unit, coupled to the detecting unit and the switching unit, for controlling the switching unit according to the detecting unit detecting the state of the input power in order to adjust a turn-on voltage of the lighting unit according to the input power;

wherein the controlling unit receives time period information of the input power indicative of a time period of the input power via the detecting unit, and sets up a plurality of predetermined time values within the time period, each of which corresponds to the state of the input power, and the controlling unit causes the switching unit to operate when the predetermined time values have been reached.

2. The illuminating apparatus according to claim 1, wherein the controlling unit detects a voltage of the input power via the detecting unit and when determining the voltage of the input power has reached a predetermined level the detecting unit causes the switching unit to operate according to the predetermined level of the input power.

3. The illuminating apparatus according to claim 1, further comprising:

a current source, coupled to the lighting unit, for providing a steady current when the lighting unit is turned on for illuminating.

4. The illuminating apparatus according to claim 3, wherein the controlling unit controls the current provided by the current source according to the turn-on voltage of the lighting unit and the current of the current source adapted to be reversely proportional to the turn-on voltage.

5. An illuminating apparatus, adapted to receive an input power which is a pulse DC, comprising:

a lighting unit, having a plurality of inter-coupled LED modules, and each of the LED modules comprising:

a first lighting set having a plurality of first LEDs serially interconnected;

a second lighting set having a plurality of second LEDs serially interconnected; and a switching circuit, coupled between the first lighting set and the second lighting set, for causing the first lighting set and the second lighting set to be interconnected in a serial manner or in a parallel manner;

a detecting unit, for detecting a state of the input power inputted to the lighting unit; and a controlling unit, coupled between the detecting unit and the switching circuit, for controlling the switching circuit based upon the detecting unit detecting the state of the input power so as to adjust a turn-on voltage of the lighting unit according to a variation in the input power;

wherein the detecting unit is a phase detecting circuit, the controlling unit receives a time period information indicative of a time period of the input power via the detecting unit, and sets up a plurality of predetermined time values within the time period, and the controlling unit controls the switching unit to operate when the time values have been reached.

6. The illuminating apparatus according to claim 5, wherein the controlling unit is a voltage detecting circuit and detects a voltage of the input power via the detecting unit and determines whether the voltage of the input power meets a predetermined voltage level, before causing the switching unit to operate according to whether the input power has reached the predetermined voltage level.

7. The illuminating apparatus according to claim 5, wherein the switching circuit further comprises:

a first switching device, coupled to the first lighting set;

a second switching device, coupled to the second lighting set; and a unilateral-conducting unit, coupled between the first switching device and the second switching device;

wherein when the first switching device and the second switching device are both conducted, the first lighting set and the second lighting set are connected in the parallel manner, and wherein when the first switching device and the second switching device are disconnected, the first lighting set and the second lighting set are connected in the serial manner and the unilateral-conducting unit is conducted.

8. The illuminating apparatus according to claim 5, further comprising:

a current source, coupled to the lighting unit, for providing a steady current when the lighting unit is turned on for illuminating.

9. The illuminating apparatus according to claim 8, wherein the controlling unit controls the current of the current source according to the turn-on voltage of the lighting unit and the current of the current source is adjusted to be reversely proportional to the turn-on voltage.

10. The illuminating apparatus according to claim 5, further comprising a switching circuit coupled between the LED modules, for controlling the LED modules to be connected in the serial manner or in the parallel manner.

11. An illuminating method for controlling a lighting unit having a plurality of lighting sets and a switching unit for causing the lighting sets to be connected in a serial manner or in a parallel manner, comprising:

detecting a state of an input power of the lighting unit, wherein the input power is in a form of a pulse DC;

controlling the switching unit according to detecting the state of the input power to adjust a turn-on voltage of the lighting unit; and determining whether predetermined time values of a time period of the input power have been reached before causing the switching unit to operate according to the corresponding time values.

12. The illuminating method according to claim 11, further comprising:

determining whether a voltage of the input power has reached a predetermined voltage level before causing the switching unit to operate.

13. The illuminating method according to claim 11, further comprising:

adjusting a current value of a current provided by a current source according to detecting the state of the input power.

14. The illuminating method according to claim 13, further comprising:

adjusting the current for the current source to be reversely proportional to the turn-on voltage of the lighting unit.

* * * * *